US006900973B2

(12) United States Patent
Tojo et al.

(10) Patent No.: US 6,900,973 B2
(45) Date of Patent: May 31, 2005

(54) ELECTROMAGNETIC LOAD DRIVE APPARATUS

(75) Inventors: Senta Tojo, Kariya (JP); Toshiyuki Yoda, Kariya (JP); Keiichi Kato, Toyohashi (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/716,493

(22) Filed: Nov. 20, 2003

(65) Prior Publication Data

US 2004/0196092 A1 Oct. 7, 2004

(30) Foreign Application Priority Data

Dec. 18, 2002 (JP) ..... 2002-366060

(51) Int. Cl.[7] ..... H01H 47/32
(52) U.S. Cl. ..... 361/139; 361/155; 361/156
(58) Field of Search ..... 361/139, 155, 361/156, 152; 123/490; 307/110; 363/60

(56) References Cited

U.S. PATENT DOCUMENTS 3,708,726 A * 1/1973 Puvogel ..... 361/156
4,933,805 A * 6/1990 Calfus ..... 361/152
4,950,974 A * 8/1990 Pagano ..... 323/222
5,491,623 A * 2/1996 Jansen ..... 363/60
5,532,526 A * 7/1996 Ricco et al. ..... 307/104
5,952,738 A * 9/1999 Miller ..... 307/116

FOREIGN PATENT DOCUMENTS

EP 548 915 6/1993
JP 57060811 * 4/1982 ..... H01F/7/18

* cited by examiner

*Primary Examiner*—Brian Sircus
*Assistant Examiner*—Z Kitov
(74) *Attorney, Agent, or Firm*—Nixon & Vanderhye P.C.

(57) ABSTRACT

A drive apparatus supplies electric power to a solenoid of an inductive load from a battery and a capacitor to improve response of the load. The drive apparatus comprises switches for switching between a first state where a negative side of the battery is connected to a positive side of the battery, and a second state where the negative side of the capacitor is connected to the negative side of the battery. When the load is in operation, the voltage applied to the solenoid is raised by the voltage of the battery as the first state, so that the current flowing into the solenoid rises sharply to improve response of the load. When the operation of the load is to be stopped, the electric power to the solenoid is interrupted, and the energy accumulated in the solenoid is recovered by the capacitor as the second state.

9 Claims, 7 Drawing Sheets

ELECTROMAGNETIC LOAD DRIVE APPARATUS

CROSS REFERENCE TO RELATED APPLICATION

This application is based on and incorporates herein by reference Japanese Patent Application No. 2002-366060 filed on Dec. 18, 2002.

FIELD OF THE INVENTION

This invention relates to an electromagnetic load drive apparatus.

BACKGROUND OF THE INVENTION

A variety of actuators are in practical use for producing a driving force by flowing an electric current into an inductive element such as a solenoid and varying the electromagnetic state. In an internal combustion engine, for example, such an actuator is mounted on an injector that injects fuel, and drives the valve of the injector.

A drive apparatus for driving the electromagnetic load having the inductive element includes a capacitor as a capacitive element in addition to a battery which is a DC low voltage power source. In this apparatus, the energy accumulated in the inductive element due to the supply of electric power is recovered by the capacitive element by generating a counter electromotive force at the time when the operation of the electromagnetic load is stopped (EP 0548 915A1, JP 2598595).

In this apparatus, the electric power is supplied to the inductive element from the capacitive element until the voltage across the terminals of the capacitive element becomes equal to the voltage across the terminals of the low voltage power source. Thereafter, the electric power is supplied from the low voltage power source.

The actuator utilizing the inductive element is highly appreciated for its response characteristics when the current supplied to the inductive element rises quickly. The rise of current supplied to the inductive element varies nearly in proportion to the voltage applied to the inductive element.

When it is desired to increase the voltage applied to the inductive element, the capacitance of the capacitive element may be decreased to elevate the voltage across the terminals of the capacitive element after the energy is recovered. From the breakdown voltage of the capacitive element, however, it is not allowed to increase the voltage across the terminals of the capacitive element.

Further, as the power source is shifted to the low voltage power source, there is almost no change in the electric current that flows into the inductive element. Namely, the energy accumulated in the inductive element does not increase so much. All energy that had been held before the operation is not recovered by the capacitive element. Therefore, the loss of energy must be replenished until the next operation. However, the energy cannot be sufficiently replenished when the interval is short until the next operation of the actuator. For example, when the same injector is consecutively operated within short periods of time like the multi-step injection of the internal combustion engine, the response drops toward the subsequent operations.

SUMMARY OF THE INVENTION

It is an object of the present invention to provide an electromagnetic load drive apparatus that attains a quick response to a sufficient degree.

According to this invention, when an inductive element operates, the applied voltage becomes the sum of a voltage across the terminals of a low voltage power source and a voltage across the terminals of a capacitive element. Therefore, the rise of current flowing into the inductive element becomes sharp by the voltage across the terminals of the low voltage power source.

Further, the inductive element accumulates the energy of an amount greater, by the voltage across the terminals of the low voltage power source, than that of the energy held by the capacitive element at the start of operation of the inductive element, and avoids a large decrease in the amount of energy recovered by the capacitive element as compared to the value at the start of operation of the electromagnetic load. Therefore, the response does not drop even when the interval is short until the next operation of the electromagnetic load. When the operation of the inductive element is discontinued, the potential of the capacitive element is brought close to the reference voltage as compared to that of during the operation, and energy can be easily recovered from the inductive element.

Preferably, even when the capacitive element of a small capacity is employed to elevate the voltage across the terminals, the electric current can be supplied to a sufficient degree by using an assisting capacitive element even after the voltage across the terminals of the capacitive element has sharply dropped. As a result, energy is accumulated to a sufficient degree in the inductive element, and the voltage across the terminals of the capacitive element after having recovered the energy can be easily recovered up to a voltage at the start of the electromagnetic load operation.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT (First Embodiment)

Figure 1:
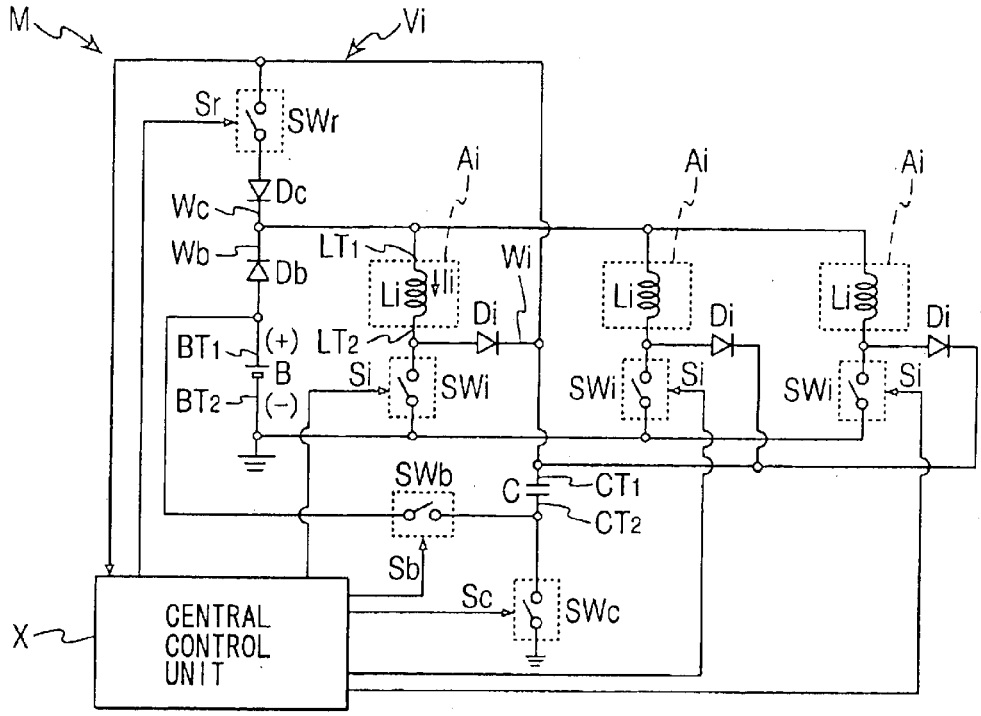
FIG. 1 is a circuit diagram of an electromagnetic load drive apparatus according to a first embodiment of the invention.

Referring first to FIG. 1 illustrating an electromagnetic load drive apparatus, an electromagnetic load drive apparatus M is common to a plurality of electromagnetic loads Ai, and selectively drives the electromagnetic loads Ai. Its example can be represented by a fuel injector of a MPI system used for internal combustion engines. Namely, in the internal combustion engine, an injector which is an electromagnetic load for injecting fuel is provided for each of the cylinders, and a solenoid which is an inductive element included in the injector changes the valve inserted in the nozzle of the injector between a seated state and a lifted state upon changing over the electromagnetic attractive force to thereby change over the fuel injection and fuel interruption. In the first embodiment, three electromagnetic loads Ai are provided for a three-cylinder internal combustion engine.

The electromagnetic loads Ai have solenoids Li corresponding to each of the electromagnetic loads Ai in a 1-to-1 manner. Each solenoid Li is provided with feeder lines Wb and Wc. The feeder line Wb becomes a single line at a base end, and the electric power is supplied from a battery B which is a common low voltage power source via a diode Db provided for the feeder line Wb. The diode Db is connected to a terminal BT1 (positive side terminal BT1 of the battery B) on the positive side of the battery B which is a terminal of the side opposite to a terminal BT2 of the reference potential side. The terminal BT2 (negative side terminal BT2 of the battery B) on the negative side of the battery B which is a terminal of the reference potential side to serve as the reference potential portion. The diode Db has the anode that is connected to the positive side terminal BT1 of the battery B. The direction in which the current is supplied from the battery B to the solenoid Li is the forward direction. Therefore, the current is inhibited from flowing in a direction reverse to the supply of current to protect the battery B.

The feeder line Wc is provided for a capacitor C which is a capacitive element serving as a source for feeding electric power to the solenoid Li. The capacitor C has one terminal CT1 that is connected to the diode Db through a switch SWr and a diode Dc. The diode Dc has the anode that is connected to one terminal CT1 of the capacitor C through the switch SWr. The direction in which the current is supplied from the capacitor C to the solenoid Li is the forward direction. A resonance circuit is formed by the capacitor C and the solenoid Li. The current tends to flow in a direction opposite to the direction in which the current is supplied. However, the current is inhibited from flowing in the direction opposite to the direction in which the current is supplied, and the current is prevented from flowing into the solenoid Li in the direction opposite to the normal flow of current. This prevents the occurrence of electromagnetic action in the solenoid Li in the direction opposite to the normal direction.

A switch SWi, which operates as switching means and selection means, is provided between the terminal BT2 (negative side of the battery B) and a terminal LT2 (terminal of the negative side) on the side opposite to the terminal (terminal of the positive side) LT1 of the solenoid Li that is connected to the positive side terminal BT1 of the battery B through the diode Db, thereby to change over the supply and interruption of current from the battery B and the capacitor C. This selects the electromagnetic load Ai that is to be operated and specifies the operation period thereof, i.e., selects the cylinder into which the fuel is to be injected and specifies the injection period in the case of an internal combustion engine. As will be described later, further, the switch SWi is used for controlling the voltage Vc across the terminals of the capacitor C.

The other terminal CT2 on the reference potential side of the capacitor C is grounded through a switch SWc which is switching means, and assumes a reference potential when the switch SWc is turned on. One terminal CT1 is referred to as the positive side terminal and the other terminal CT2 is referred to as the negative side terminal. The terminal CT2 is further connected to the positive side terminal BT1 of the battery B through a switch SWb which is switching means. Upon changing over the switches SWb and SWc, the connection between the battery B and the capacitor C can be changed over. That is, when the switch SWb is turned on and the switch SWc is turned off, the positive side terminal BT1 of the battery Bis rendered conductive to the negative side terminal CT2 of the capacitor C, whereby the voltage applied to the solenoid Li becomes equal to the sum of the voltage Vb (voltage across the battery terminals) across the terminals of the battery B and the voltage Vc (voltage across the capacitor terminals) across the terminals of the capacitor C provided the switches SWi and SWr are turned on (first state).

When the switch SWb is turned off and the switch SWc is turned on, on the other hand, the negative side terminal CT2 of the capacitor C is connected to the negative side terminal BT2 of the battery B (second state). As will be described later, the energy can be recovered by the capacitor C from the solenoid Li provided the switch SWi is turned on.

A recovering line Wi is provided between the negative side terminal LT2 of the solenoid Li and the positive side terminal CT1 of the capacitor C being corresponded to the solenoid Li in a 1-to-1 manner to recover in the capacitor C the energy accumulated in the solenoid Li. A diode Di is provided in the recovering line Wi in such a manner that the direction in which the current is recovered by the capacitor C from the solenoid Li is the forward direction, i.e., in such a manner that the anode is connected to the solenoid Li.

The diode Di inhibits the flow of current in a direction opposite to the flow of recovery current. Therefore, no current is recovered by the capacitor C1 from the solenoid Li. When all the energy in the solenoid Li migrates into the capacitor C1, the recovery of energy is completed without involving the switching operation. Further, the positive side terminal CT1 of the capacitor C is prevented from being grounded when the switch SWi is turned on like the electromagnetic load Ai in operation.

The switches SWi, SWb, SWc and SWr are constituted by power MOSFETs, and are controlled by a central control unit X. The central control unit X is constructed with a microcomputer or the like, sends control signals Si, Sb, Sc and Sr to the switches SWi, SWb, SWc and SWr to turn the switches SWi, SWb, SWc and SWr on and off. Further, the central control unit X receives a potential (capacitor potential) from the positive side terminal CT1 of the capacitor C and a potential (voltage Vb across the terminals of the battery B) from the positive side terminal BT1 of the battery B, and calculates the timings for producing the control signals Si, Sb, Sc and Sr based on the inputs.

Figure 2:
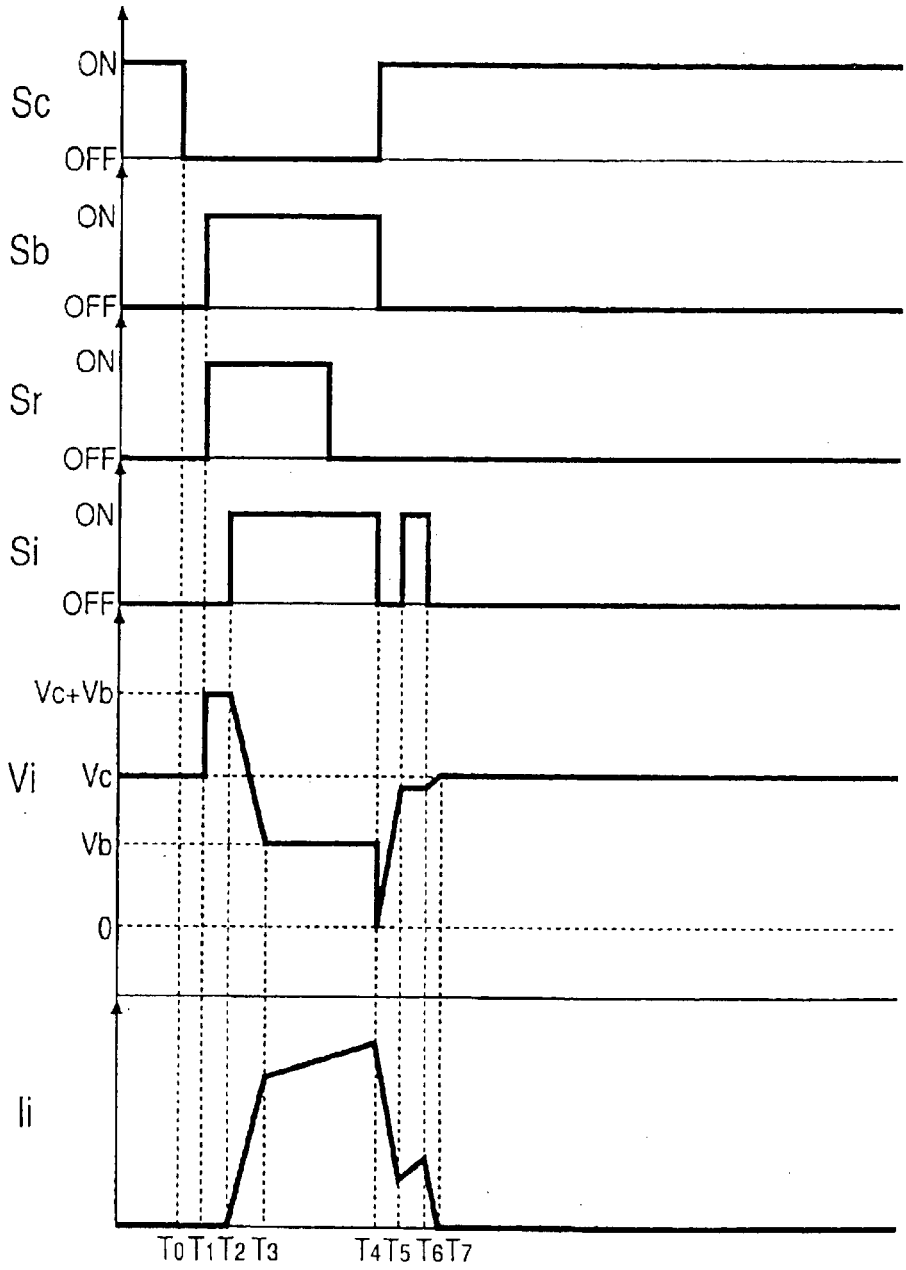
FIG. 2 is a timing chart illustrating the operation of the first embodiment.

The operation of the electro magnetic load drive apparatus M will now be described. FIG. 2 illustrates the state of operation of each of the portions of the electromagnetic load drive apparatus M, assuming that the switch SWc is turned off at timing T0 prior to starting the operation of the electromagnetic load Ai and, then, the switches SWb and SWr are turned on at timing T1. This is the first state where the capacitor potential Vi rises from the voltage Vc across the terminals of the capacitor C up to the sum (Vc+Vb) of the voltage Vb across the terminals of the battery B and the voltage Vc across the terminals of the capacitor C. Further, since the switch SWr is turned on, the positive side terminal CT1 of the capacitor C is conductive to a point where the diodes Db and Dc are connected together. Here, the diode Dc is forwardly biased but the diode Db is reversely biased.

Next, at the start (timing T2) of operation of the electromagnetic load Ai in response to the signal Si, the switch SWi is turned on that corresponds to any one of the three electromagnetic loads Ai that is to be operated. Then, the voltage (Vc+Vb) is applied to the solenoid Li, and a current Ii starts flowing into the solenoid Li. At this moment, the rise of current Ii, i.e., the rising rate of the current Ii is proportional to the voltage (Vc+Vb) applied to the solenoid Li. The voltage Vc across the terminals of the capacitor and the capacitor voltage Vi decrease as the solenoid current Ii flows.

When the capacitor potential Vi becomes equal to the voltage Vb across the terminals of the battery B at timing T3, the diode Db is forwardly biased. Then, the voltage applied to the solenoid Li assumes the voltage Vb across the terminals of the battery B. The rising rate of the solenoid current Ii becomes slower than before.

The operation of the electromagnetic load Ai is stopped or interrupted as described below. First, the switch SWr is turned off prior to stopping the operation of the electromagnetic load Ai at timing T4. As will be described later, this is to inhibit the current from flowing again into the solenoid Li from the capacitor C through the diode Dc, since the capacitor voltage Vc rises as the energy is recovered by the capacitor C from the solenoid Li.

At timing T4, the switches SWi and SWb are turned off, and the switch SWc is turned on. This is the second state. The switch Si is then turned on and off. During the OFF period (T4 to T5) of the switch Si, a counter-electromotive force is produced in the solenoid Li, the diode Di is forwardly biased, and a recovery current flows through a path of solenoid Li-diode Di-capacitor C, and the energy accumulated in the solenoid Li is recovered by the capacitor C. Therefore, the voltage Vc across the terminals of the capacitor C rises and the capacitor potential Vi is restored toward the capacitor potential Vc of before starting the operation.

During the ON period (T5 to T6) of the switch Si, a current flows again through the path of battery B-diode Db-solenoid Li-switch SWi-battery B, and the energy accumulates in the solenoid Li. During the next OFF period (T6 to T7), a recovery current flows through the path of solenoid Li-diode Di-capacitor C, and the energy accumulated in the solenoid Li is recovered by the capacitor C.

The central control unit X fixes the switch SWi to OFF as the capacitor potential Vi or the voltage Vc across the terminals of the capacitor assumes a preset end voltage (T7). Thus, the selected electromagnetic loads Ai are successively controlled.

In the illustrated embodiment, the ON period and the OFF period are set to be of the same length. The embodiment, however, is in no way limited thereto only. The ON period may be set to be, for example, of a predetermined length, and the current flowing into the solenoid Li may be monitored such that the OFF period may be terminated, i.e., the ON period may be entered every time when the monitored current becomes 0. The first OFF period (T4 to T5) of the switch Si is long enough for the solenoid current Ii to decrease down to a value at which the electromagnetic load Ai ceases to operate, as a matter of course.

In the electromagnetic load drive apparatus M, at the start of operation of the electromagnetic load Ai, the voltage applied to the solenoid Li becomes the sum (Vc+Vb) of the voltage Vc across the terminals of the capacitor C and the voltage Vb across the terminals of the battery B. Therefore the current flowing into the solenoid Li rises correspondingly, and the response of the electromagnetic load Ai is improved.

At the start of operation of the electromagnetic load Ai, further, the solenoid Li accumulates the energy larger, by an amount corresponding to the voltage Vb across the terminals of the battery B, than the energy held by the capacitor C. The energy recovered to the capacitor C is avoided from being greatly decreased as compared to that of at the start of the operation of the electromagnetic load Ai. Therefore, the capacitor potential Vi is recovered up to the voltage at the start of operation through a small number of times of on/off operation of the switch Si. Therefore, the response does not drop despite the interval is short until the next operation of the electromagnetic load Ai. When the operation of the solenoid Li is interrupted, the potential of the capacitor C is brought close to the reference potential by the voltage Vb across terminals of the battery as compared to that of during the operation, and the energy can be easily recovered from the solenoid Li.

(Second Embodiment)

Figure 3:
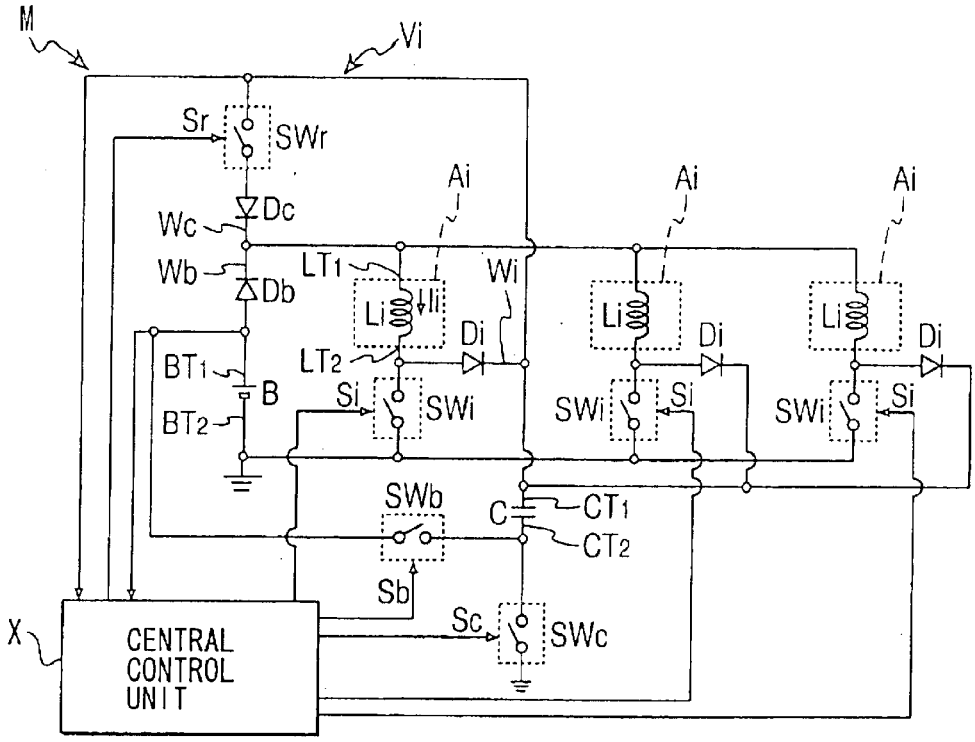
FIG. 3 is a circuit diagram of an electromagnetic load drive apparatus according to a second embodiment of the invention.

As shown in FIG. 3, an electromagnetic load drive apparatus M according to a second embodiment is constructed in the similar manner as the first embodiment. In the first embodiment, the recovery of energy when the operation is stopped is completed as the voltage Vc across the terminals of the capacitor C assumes the predetermined end voltage. According to the second embodiment, however, the operation characteristics of the electromagnetic load Ai can be further improved.

The central control unit X receives the capacitor potential Vi as well as the positive side potential (=voltage Vb across the terminals of the battery) of the battery B, and sets a period for completing the charging of the capacitor C based on the capacitor potential Vi and the voltage Vb across the terminals of the battery B.

That is, the central control unit X sets the end voltage of the capacitor potential Vi (=voltage Vc across the terminals of the capacitor) so that the end voltage does not become constant but that the sum (Vb+Vc) of the voltage Vb across the terminals of the battery and the voltage Vc across the terminals of the capacitor C becomes constant (Vk). Namely, the end voltage is given by (Vk−Vb).

Figure 4:
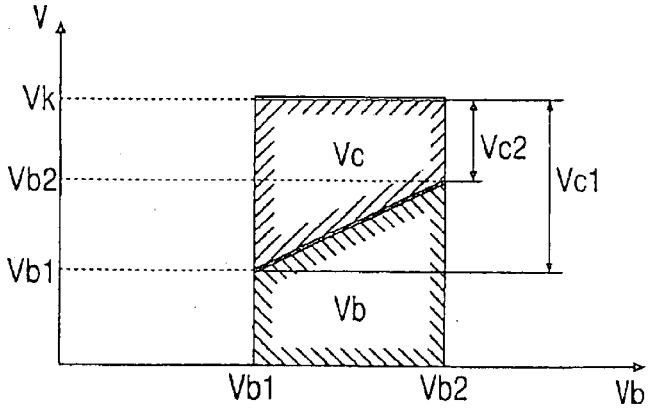
FIG. 4 is a graph illustrating the operation of the second embodiment.

Therefore, as the voltage Vb across the terminals of the battery B varies depending upon the conditions of other loads supported by the battery B, the end voltage varies correspondingly. If the voltage Vb across the terminals of the battery B drops from Vb2 to Vb1 as shown in FIG. 4, the end voltage rises from Vc2 (=Vk−Vb2) to Vc1 (=Vk−Vb1>Vc2).

Therefore, even when the voltage Vb across the terminals of the battery B varies, the voltage applied to the solenoid Li can be set to be constant at the start of operation. The rise of the solenoid current Ii can be set to be constant at the start of operation.

(Third Embodiment)

Figure 5:
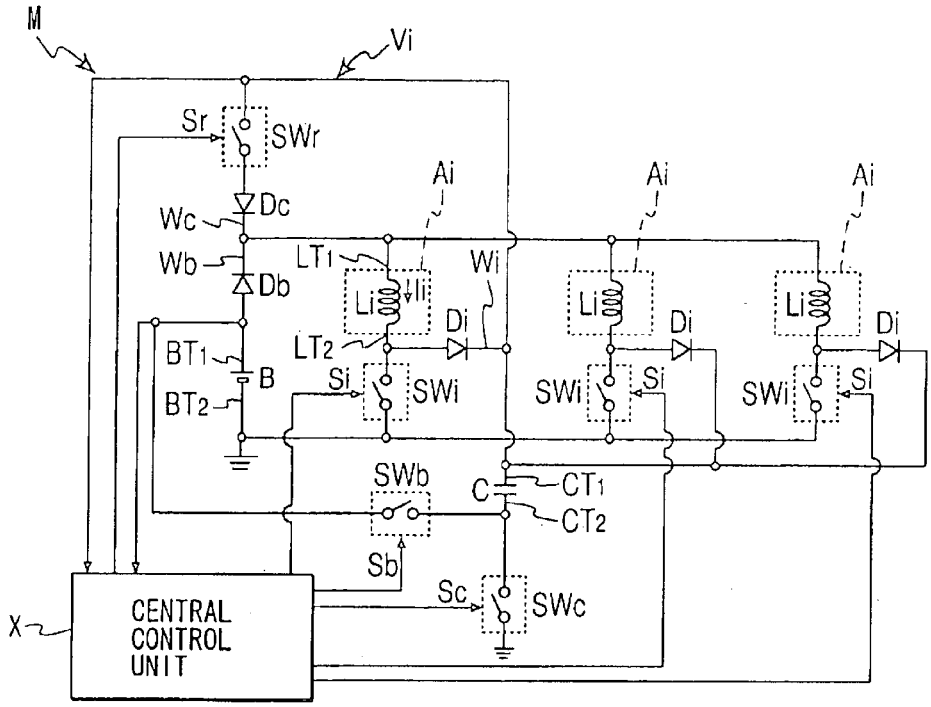
FIG. 5 is a circuit diagram of an electromagnetic load drive apparatus according to a third embodiment of the invention.

As shown in FIG. 5, an electromagnetic load drive apparatus M according to a third embodiment is constructed in the similar manner as the second embodiment.

In the third embodiment, the central control unit X sets the timing for completing the charging of the capacitor C based on the capacitor potential Vi and the voltage Vb across the terminals of the battery B.

That is, the central control unit X sets the end voltage of the capacitor potential Vi (=voltage Vc across the terminals of the capacitor C) so that the sum (Vb+Vc) of the voltage Vb across the terminals of the battery B and the voltage Vc across the terminals of the capacitor C assumes a predetermined value Vs.

That is, the central control unit X sets the end voltage of the capacitor potential Vi (=voltage Vc across the terminals of the capacitor C) so that the sum (Vb+Vc) of the voltage Vb across the terminals of the battery B and the voltage Vc across the terminals of the capacitor C assumes the predetermined value Vs. Here, however, the predetermined value Vs varies depending upon the voltage Vb across the terminals of the battery B. Namely, the predetermined value Vs increases with a decrease in the voltage Vb across the terminals of the battery B.

Figure 6:
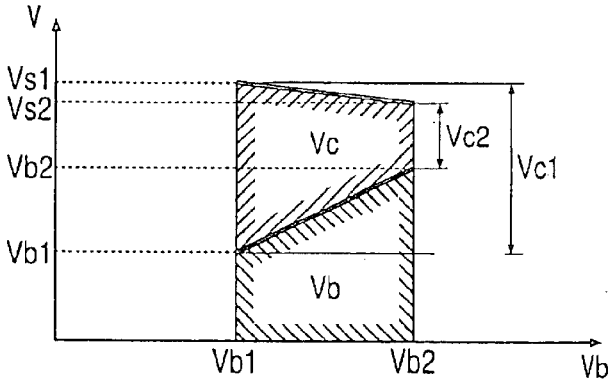
FIG. 6 is a graph illustrating the operation of the third embodiment.

As shown in FIG. 6, therefore, as the voltage Vb across the terminals of the battery B drops from Vb2 down to Vb1, the predetermined value Vs rises from Vs2 to Vs1, and the end voltage rises from Vc2 (=Vs2−Vb2) to Vc1 (=Vs1−Vb1>Vc2). Since Vs2<Vs1, in this embodiment, the end voltage of the capacitor potential Vi (=voltage Vc across the terminals of the capacitor C) increases to be greater than that of the second embodiment when the voltage Vb across the terminals of the battery B drops.

Figure 7:
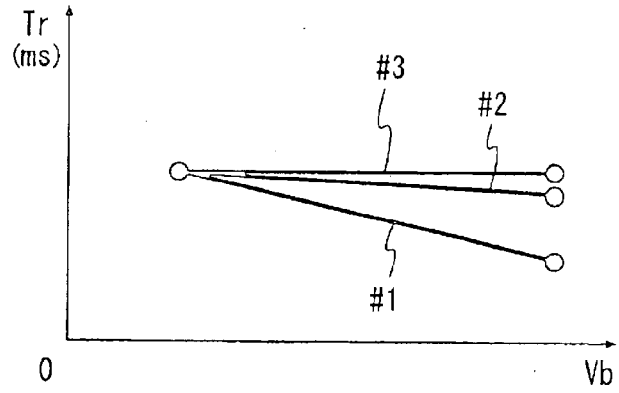
FIG. 7 is a graph comparing the electromagnetic load drive apparatuses of the first to the third embodiments.

FIG. 7 illustrates the results of measuring the valve response time Tr of the injector while varying the voltage Vb across the terminals of the battery B when the electromagnetic load drive apparatuses of the first to the third embodiments (#1 to #3) are applied to the fuel injection device of an internal combustion engine. The valve response is defined by the time from the start of feeding the current to the solenoid Li for fuel injection operation until the valve is fully lifted. When the voltage Vc across the terminals of the capacitor C is simply charged up to the predetermined end voltage like in the first embodiment, the fluctuation in the voltage Vb across the terminals of the battery B is directly reflected on the rise of the solenoid current Ii at the start of operation of the electromagnetic load, and the response of valve correspondingly varies.

According to the second embodiment, however, the rising rates of the solenoid currents Ii at the start of the operation of the electromagnetic load are uniformed, and variation in the valve response is improved. According to the third embodiment, further, the variation in the valve response is more improved than that of the second embodiment.

This is due to that among the voltages applied to the solenoid Li, the voltage component (Vb) due to the battery B assumes nearly a constant value after the start of operation of the electromagnetic load while the voltage component (Vc) due to the capacitor C tends to decrease as the electric current is fed to the solenoid Li. That is, in the second and third embodiments, as the voltage Vb across the terminals of the battery decreases, the amount of decrease is replaced by the voltage component due to the capacitor C1 that tends to decrease as the current is fed to the solenoid Li. In the second embodiment, therefore, even if the rising characteristics are uniformed right after the start of operation of the electromagnetic loads, the rising characteristics within a predetermined period of time (from T2 to T3 in FIG. 2) at the start of operation of the electromagnetic loads differ depending upon a ratio of the voltage component (Vb) due to the battery B to the voltage component (Vc) due to the capacitor C. Specifically, as the voltage Vb across the terminals of the battery B drops and the ratio of the voltage component (Vc) due to the capacitor C increases, the rising characteristics become slow remarkably in the latter half in the predetermined period of time at the start of operation of the electromagnetic load.

In the third embodiment, when the voltage Vb across the terminals of the battery B decreases, the capacitor potential Vi is made greater than that (Vb+Vc=Vk (constant)) of the second embodiment. Therefore, the rising characteristics become slow in the latter half in the predetermined period of time at the start of operation of the electromagnetic load, and variation in the response of valve can be suppressed.

The injectors can be contrived in a variety of structures such as the one in which a valve for opening and closing the injection port is directly driven by a solenoid, and the one in which a valve for control is actuated by a solenoid. In any structure, the period in which a current flowing into the solenoid reaches a sufficient magnitude, affects the response time significantly until a driving force attains the pressure for opening the valve driven by the solenoid or significantly affects the time until the valve is fully lifted. Therefore, the third embodiment of the invention can be applied particularly preferably to the fuel injection apparatus.

(Fourth Embodiment)

Figure 8:
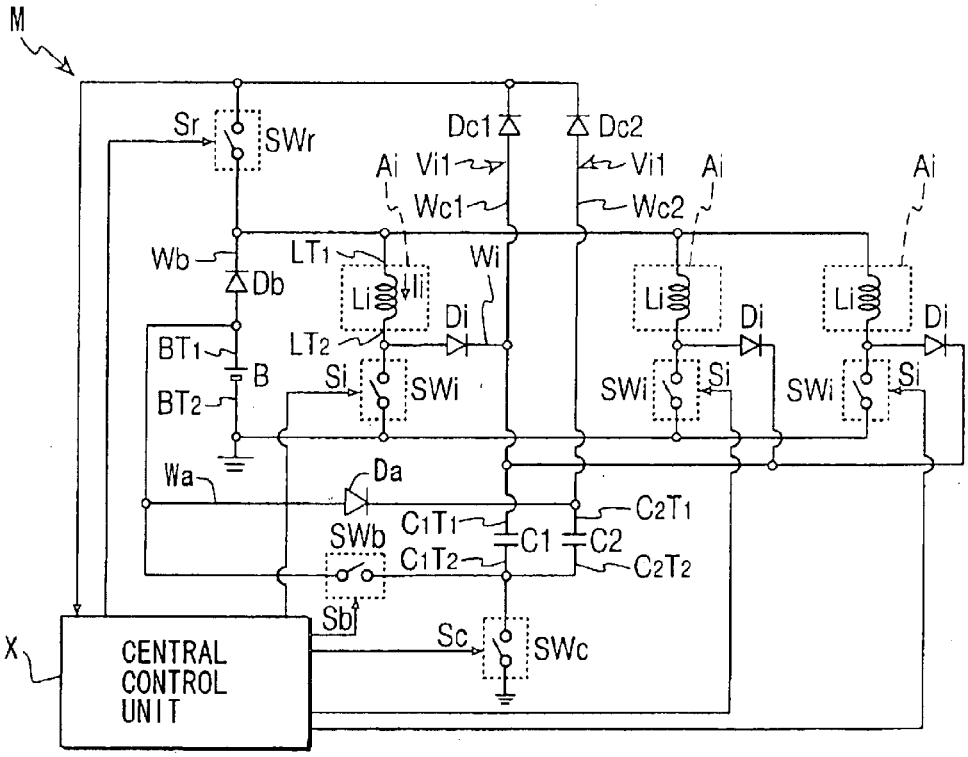
FIG. 8 is a circuit diagram of an electromagnetic load drive apparatus according to a fourth embodiment of the invention.

As shown in FIG. 8, an electromagnetic load drive apparatus M according to a fourth embodiment is constructed in the similar manner as the first embodiment.

The electromagnetic load drive apparatus M is provided with two capacitors C1 and C2. The capacitor C1 is a capacitive element serving as a power source. The capacitor C2 is an assisting capacitive element. The capacitor C1 is substantially the same as the capacitor C of the first embodiment. The capacitor C2 has a capacitance larger than that of the capacitor C1. The capacitor C1 is referred to as small capacitor C1, and the capacitor C2 is referred to as large capacitor C2. The electric power can be fed to the solenoid Li from the small capacitor C1 through a feeder line Wc1, and the electric power can be fed to the solenoid Li from the large capacitor C2 through a feeder line Wc2. The small capacitor C1 and the large capacitor C2 are capable of feeding electric power to the solenoid Li in parallel.

The feeder lines Wc1 and Wc2 are coupled into one through the switch SWr, and are provided with diodes Dc1 and Dc2. The diode Dc1 has its anode connected to the positive side terminal C1T1 of the capacitor C1. The direction in which the current is supplied from the capacitor C1 to the solenoid Li is the forward direction. The diode Dc2 has its anode connected to the positive side terminal C2T1 of the capacitor C2. The direction in which the current is supplied from the capacitor C2 to the solenoid Li is the forward direction.

The diode Dc1 on the side of the small capacitor C1 works substantially in the same manner as the diode Dc in the first embodiment. The diode Dc2 is inserted from the standpoint that a resonance circuit is formed by the large capacitor C2 and the solenoid Li, and that a current tends to flow in a direction opposite to the feed current. The diode Dc2 works to inhibit the current from flowing in a direction opposite to the feed current and prevents the current from flowing into the solenoid Li in a direction opposite to that of normal current.

Further, a terminal of the large capacitor C2 on the side of the diode Dc2 is connected to the positive side terminal BT1 of the battery through a charging line Wa, and the large capacitor C2 can be electrically charged from the battery B. The charging line Wa is provided with a diode Da with its anode on the side of the battery B, and a direction in which the charging current flows from the battery B to the large capacitor C2 is the forward direction.

Figure 9:
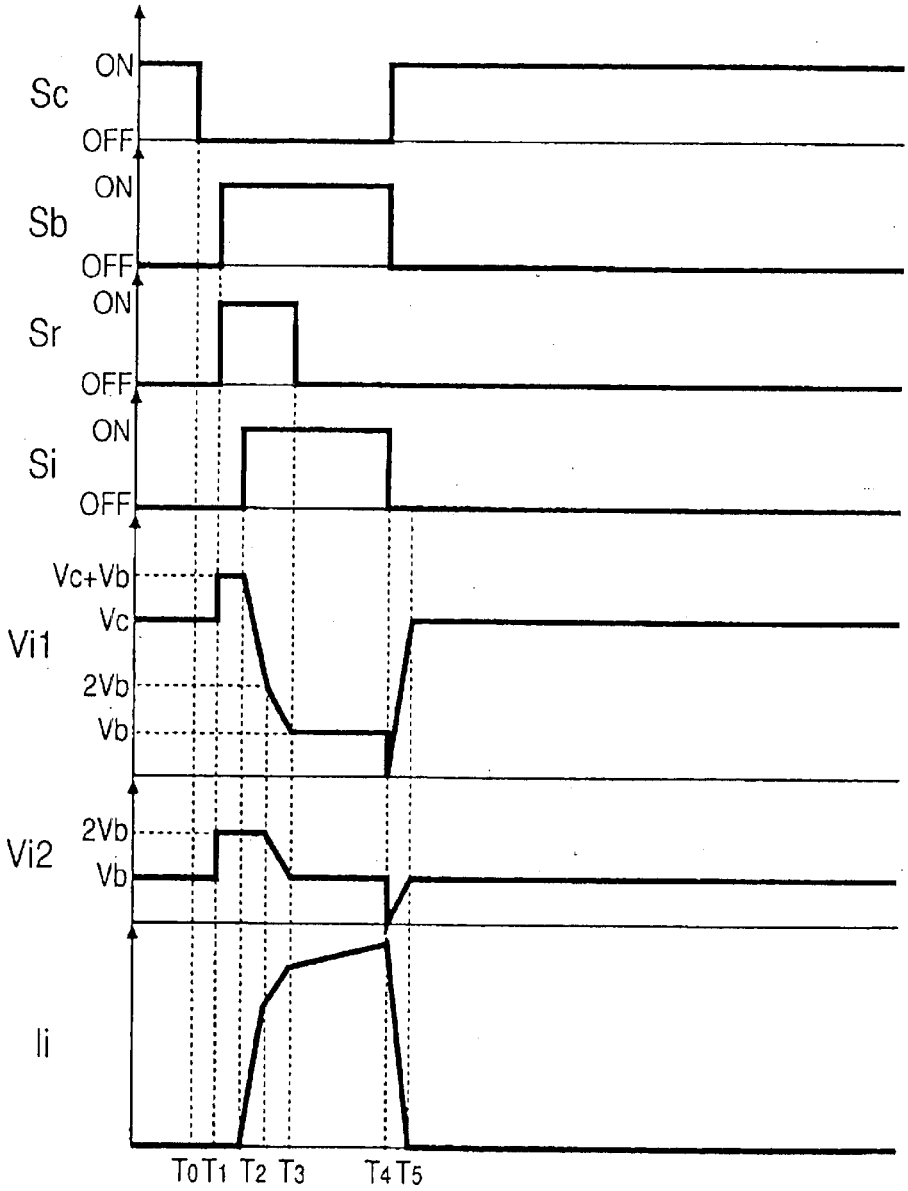
FIG. 9 is a first timing chart illustrating the operation of the fourth embodiment.

Next, described below is the operation of the electromagnetic load drive apparatus M. The central control unit X in the electromagnetic load drive apparatus M executes substantially the same control operation as that of the first embodiment. FIG. 9 illustrates the state of operation of each of the portions of the electromagnetic load drive apparatus M. The control operations of the switches SWc, SWb, SWr and SWi for starting the operation of the electromagnetic load Ai are the same as those of the first embodiment. In a state where the switch SWc is ON and the switch SWb is OFF, the diode Da is forwardly biased, and the large capacitor C2 is charged up to the voltage Vb across the terminals of the battery B.

As the switch SWb is turned on at timing T1, therefore, the potential (large capacitor potential) Vi2 of the large capacitor C2 on the side of the diode Dc2 is raised by the voltage Vb across the terminals of the battery B like the potential (small capacitor potential) Vi1 of the small capacitor C1 on the side of the diode Dc1. Further, the small capacitor C1 is charged up to a voltage higher than the voltage (=Vb) across the terminals of the large capacitor C2 as the energy is recovered from the solenoid Li as will be described later. Therefore, the large capacitor potential Vi2 is lower than the small capacitor potential Vi1, and the diode Dc2 is reversely biased.

In feeding the electric power to the solenoid Li after timing T2, the diode D6 is reversely biased as described above, and the electric power is fed to the solenoid Li from the small capacitor C1.

Then, as the small capacitor potential Vi1 drops down to the large capacitor potential Vi2 (=2Vb), the electric power is, then, supplied from both the small capacitor C1 and the large capacitor C2. Then, as is understood from FIG. 9, the small capacitor potential Vi1 (=large capacitor potential Vi2) which is the voltage applied to the solenoid Li drops more slowly than the small capacitor potential Vi1 which is the voltage applied to the solenoid Li used. Therefore, the solenoid current Ii increases without being greatly suppressed from rising.

The operation of the electromagnetic load Ai is discontinued by turning the switches SWi and SWb off and the switch SWc on at timing T4 as in the first embodiment. In the fourth embodiment, however, the electric power is supplied from both the small capacitor C1 and the large capacitor C2 as described above. Therefore, the voltage Vc1 across the terminals of the small capacitor can be recovered at one time up to the voltage before starting the operation in recovering the energy only to the small capacitor C1. Therefore, the central control unit X does not charge the small capacitor C1 by turning the switch Si on and off. However, the central control unit X may charge the small capacitor C1 to cope with the loss of energy due to the passage of time, as a matter of course.

Thus, the next operation can be conducted without separately charging the small capacitor C1 as opposed to the first embodiment (period from T5 to T7). Accordingly, the embodiment can be desirably adapted even when the interval is very short until the next operation of the electromagnetic load Ai. There is required neither a DC-DC converter for obtaining a necessary application voltage nor a large capacitor that is electrically charged with the voltage thereof, and the cost can be decreased.

Upon changing over the switches SWi SWb and SWc at the time of discontinuing the operation of the electromagnetic load Ai, the diode Da is forwardly biased and the large capacitor C2 is electrically charged from the battery B through the diode Da, as a matter of course.

Figure 10:
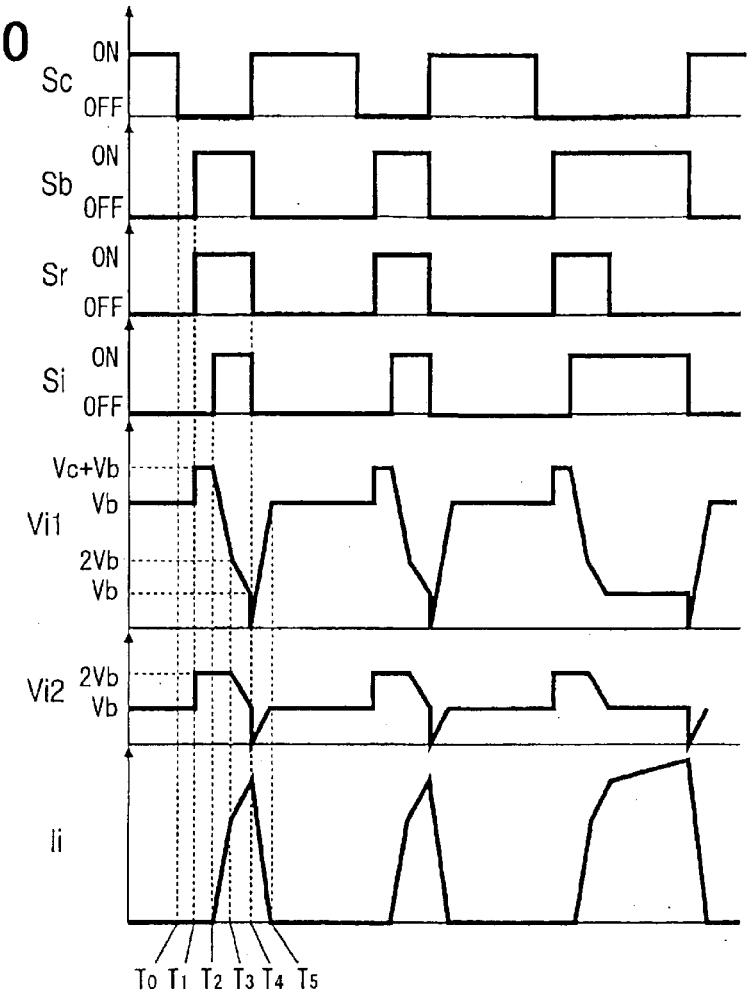
FIG. 10 is a second timing chart illustrating the operation of the fourth embodiment.

FIG. 10 illustrates an example where the interval is short until the operation of the next electromagnetic load Ai, and represents a multi-step injection in injecting fuel in, for example, an internal combustion engine. The voltage Vc1 across the terminals of the small capacitor C1 can be recovered at one time up to the voltage Vc of before starting the operation. Hence, a plurality of electromagnetic loads can be operated successively. Further, the plurality of electromagnetic loads can be successively operated at a short interval. In this case, the drive circuit need not be provided for each of the electromagnetic loads, and the cost can be decreased.

The voltage Vc1 across the terminals of the small capacitor restored by recovering the energy accumulated in the solenoid Li, varies depending upon the capacity of the large capacitor C2 and may, hence, be set by taking into consideration the rising characteristics of the required solenoid current Ii, such as the solenoid current Ii at T3.

Figure 11:
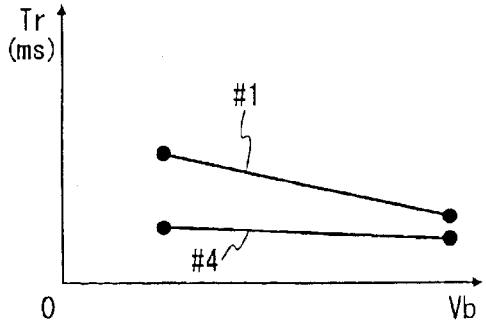
FIG. 11 is a graph comparing the electromagnetic load drive apparatuses of the first and the fourth embodiments.

FIG. 11 compares the valve response Tr of the first embodiment (#1) without the large capacitor C2 with the valve response Tr of the fourth embodiment (#4). It will be understood that the fourth embodiment exhibits superior valve response irrespective of the voltage Vb across the terminals of the battery B.

The fourth embodiment having the large capacitor C2 employs the small capacitor C1 having a sufficiently small capacity to improve the rising characteristics of the solenoid current Ii. Therefore, if the capacitances of the capacitors C1 and C2 are denoted by C1 and C2, then, it is preferred that C1<C2 as in this embodiment. The capacitor C2 is to supplement the lack of the power-feeding ability of the capacitor C1 that recovers the energy from the solenoid Li. Depending upon the amount of supplementing the required power-feeding ability, however, the capacitor C2 may have a capacitance smaller than that of the capacitor C1.

The present invention may be modified in various ways without departing from the spirit of the invention.

What is claimed is:

1. An electromagnetic load drive apparatus for a plurality of electromagnetic loads each having an inductive element, the apparatus comprising:

a DC low voltage power source;

a capacitive element as a power source for feeding electric power to the inductive element of one of the electromagnetic loads at the time of operating said one of the electromagnetic loads, and recovering energy accumulated in the inductive element due to supply of electric power, the energy being recovered by the capacitive element at the time when the operation of said one of the electromagnetic loads is stopped;

a first switching device for switching between a first state where a terminal of the capacitive element on a reference potential side is connected to a terminal of the low voltage power source on a side opposite to the terminal of the reference potential side and a second state where the terminal of the capacitive element on the reference potential side is connected to a terminal of the low voltage power source on the reference potential side; and a control unit for controlling the first switching device to select the first state when said one of the electromagnetic loads is in operation so that the electric power is fed to the inductive element from the capacitive element and the low voltage power source that are connected in series, and to select the second state when the operation of said one of the electromagnetic loads is stopped;

wherein the capacitive element is connected to the plurality of electromagnetic loads in common.

2. An electromagnetic load drive apparatus for an electromagnetic load having an inductive element, the apparatus comprising:

a DC low voltage power source;

a capacitive element as a power source for feeding electric power to the inductive element at the time of operating the electromagnetic load, and recovering energy accumulated in the inductive element due to supply of electric power, the energy being recovered by the capacitive element at the time when the operation of the electromagnetic load is stopped;

a first switching device for switching between a first state where a terminal of the capacitive element on a reference potential side is connected to a terminal of the low voltage power source on a side opposite to the terminal of the reference potential side and a second state where the terminal of the capacitive element on the reference potential side is connected to a terminal of the low voltage power source on the reference potential side;

a control unit for controlling the first switching device to select the first state when the electromagnetic load is in operation so that the electric power is fed to the inductive element from the capacitive element and the low voltage power source that are connected in series, and to select the second state when the operation of the electromagnetic load is stopped; and an assisting capacitive element which is another capacitive element in parallel with the capacitive element for feeding electric power to the inductive element, the assisting capacitive element being electrically charged by the low voltage power source in the second state.

3. An electromagnetic load drive apparatus according to claim 2, further comprising:

a charging line for electrically charging the assisting capacitive element from the low voltage power source and having a diode which sets, as a forward direction, a direction in which the charging current flows from the low voltage power source to the assisting capacitive element.

4. An electromagnetic load drive apparatus according to claim 1, further comprising:

a recovery line for recovering the energy accumulated in the inductive element by the capacitive element and having a diode which sets, as a forward direction, a direction in which a recovering current flows from the inductive element to the capacitive element.

5. An electromagnetic load drive apparatus according to claim 1, further comprising:

a feeder line for the low voltage power source for feeding the electric power from the low voltage power source to the inductive element and having a diode, which sets, as a forward direction, a direction in which a feeding current flows from the low voltage power source to the inductive element.

6. An electromagnetic load drive apparatus according to claim 1, further comprising:

a feeder line for the capacitive element for feeding electric power to the inductive element from the capacitive element and having a diode which sets, as a forward direction, a direction in which the feeding current flows from the capacitive element to the inductive element.

7. An electromagnetic load drive apparatus for an electromagnetic load having an inductive element, the apparatus comprising:

a DC low voltage power source;

a capacitive element as a power source for feeding electric power to the inductive element at the time of operating the electromagnetic load, and recovering energy accumulated in the inductive element due to supply of electric power, the energy being recovered by the capacitive element at the time when the operation of the electromagnetic load is stopped;

a first switching device for switching between a first state where a terminal of the capacitive element on a reference potential side is connected to a terminal of the low voltage power source on a side opposite to the terminal of the reference potential side and a second state where the terminal of the capacitive element on the reference potential side is connected to a terminal of the low voltage power source on the reference potential side;

a control unit for controlling the first switching device to select the first state when the electromagnetic load is in operation so that the electric power is fed to the inductive element from the capacitive element and the low voltage power source that are connected in series, and to select the second state when the operation of the electromagnetic load is stopped; and a second switching device for opening and closing the feeder line for the low voltage power source, wherein the control unit controls the second switching device so that the second switching device is turned on and off at the time when the energy is recovered by the capacitive element from the inductive element, and transfers the energy accumulated in the inductive element during an ON period of the second switching device to the capacitive element during an OFF period of the second switching device, and stops turning on and off operation of the second switching device when the voltage across the terminals of the capacitive element assumes a predetermined end voltage.

8. An electromagnetic load drive apparatus according to claim 7, wherein the control unit sets the end voltage so that a sum of a voltage across the terminals of the low voltage power source and the end voltage assumes a predetermined value.

9. An electromagnetic load drive apparatus according to claim 7, wherein the control unit sets the end voltage so that a sum of the voltage across the terminals of the low voltage power source and the end voltage assumes a predetermined value that is set based on the voltage across the terminals of the low voltage power source, and sets the predetermined value to a value that increases with a decrease in the voltage across the terminals of the low voltage power source.

* * * * *